US005934662A

United States Patent [19]

Acquaviva

[11] Patent Number: 5,934,662

[45] Date of Patent: Aug. 10, 1999

[54] BOTTOM SHEET SEPARATOR-FEEDER WITH SHEET STACK LEVITATION

[75] Inventor: Thomas Acquaviva, Penfield, N.Y.

[73] Assignee: Xerox Corporation, Stamford, Conn.

[21] Appl. No.: 08/950,025

[22] Filed: Oct. 14, 1997

[51] Int. Cl.[6] ..... B65H 3/16

[52] U.S. Cl. ..... 271/18.1; 271/35; 271/146; 271/166

[58] Field of Search ..... 271/18.1, 18.2, 271/35, 105, 133, 134, 135, 146, 166

[56] References Cited

U.S. PATENT DOCUMENTS

| | | | |
|---|---|---|---|
| 3,357,325 | 12/1967 | Eichorn et al. . | |
| 3,612,512 | 10/1971 | Lang | 271/35 |
| 3,642,362 | 2/1972 | Mueller | 355/3 |
| 3,717,801 | 2/1973 | Silverberg | 317/262 |
| 3,976,370 | 8/1976 | Goel et al. | 355/3 |
| 4,397,459 | 8/1983 | Silverberg et al. | 271/105 |
| 4,526,357 | 7/1985 | Kuehnle et al. | 271/18.2 |
| 4,955,598 | 9/1990 | Hiroshige et al. | 271/267 |
| 5,026,040 | 6/1991 | Gilbert | 271/35 |

FOREIGN PATENT DOCUMENTS

| | | | |
|---|---|---|---|
| 1285227 | 12/1968 | Germany | 271/35 |
| 403211130 | 9/1991 | Japan | 271/18.1 |

OTHER PUBLICATIONS

Xerox Disclosure Journal vol. 16, No. 2, Mar./Apr. 199, p. 81, "Ultrasonic Sheet Separation", by Martin, et al.

*Primary Examiner*—H. Grant Skaggs

[57] ABSTRACT

A bottom sheet feeding system for feeding individual image substrate sheets for reproduction apparatus out from under a stack of such sheets by intermittently feeding the bottom sheet out from under the overlying stack of sheets in a sheet stacking tray with a bottom sheet feeder, which may be electrostatic, while that stack of sheets is intermittently at least partially levitated relative to the bottom sheet to substantially reduce the gravitational force of the overlying stack of sheets normally bearing down on the bottom sheet to resist the separation and feeding of the bottom sheet out from under the rest of the stack. This intermittent stack levitation may be accomplished by appropriate cyclical transducer system forces applied to the bottom of the stacking tray at a frequency coordinated with intermittent feeding of the bottom sheet out from under the stack.

6 Claims, 3 Drawing Sheets

BOTTOM SHEET SEPARATOR-FEEDER WITH SHEET STACK LEVITATION

Disclosed in the embodiment herein is a sheet feeding system for feeding individual image substrate sheets out from under a stack of sheets (commonly known as a bottom sheet feeder) by intermittently feeding the bottom sheet out from under the overlying stack of sheets in a sheet stacking tray while that stack of sheets is intermittently at least partially levitated relative to the bottom sheet to substantially reduce the gravitational force of the overlying stack of sheets normally bearing down on the bottom sheet to resist the separation and feeding of the bottom sheet out from under the rest of the stack. This intermittent levitation may be accomplished by appropriate cyclical transducer system forces applied to the bottom of the stacking tray, preferably at a frequency coordinated with the intermittent feeding of the bottom sheet out from under the stack.

Bottom sheet feeding per se is well known and desired in various sheet feeding situations, such as where it is desired to load a normal 1 to N collated page order stack of documents face up in a document stacking tray and feed them sequentially to be imaged from the bottom of the stack so that they are fed in reverse or N to 1 page order, as desired for certain copying or other imaging systems. Or, for such document stacks to be loaded face down and fed out of the stack in 1 to N page order by the bottom feeder, such as in many facsimile machines, copiers, and digital scanners with document feeders.

Various types of bottom sheet feeders, and other sheet feeders which could be used in part as part of a bottom sheet feeder, are known in the art. For example, vacuum belt corrugating air knife assisted bottom sheet feeders (known as VCF feeders), such as in Xerox Corp. U.S. Pat. Nos. 4,324,395; 4,411,417; or 4,418,905.

Of particular interest to an embodiment here, although not limited thereto, are electrostatic sheet feeders, which, for example, may attract a sheet to a transport belt with electrostatic fields from electrostatic charges. The following patent disclosures are noted as examples: Xerox Corp. U.S. Pat. Nos. 3,357,325; 3,642,362; 3,717,801; and 3,976,370.

The subject bottom sheet feeding system should not be confused with either "wave" type sheet feeders and/or vibration type sheet feeders, such as U.S. Pat. No. 4,955,598. Or, ultrasonic sheet separation assistance as in Xerox Disclosure Journal Vol. 16, no. 2, March/April 1991, p. 81. Some document or envelope feeders have also been known to provide bottom "thumpers" to intermittently hit the bottom of the stack being fed, for improved separation and feeding, such as by rotating uneven, e.g., "D" shaped, feed wheels or cams against the bottom of the stack through apertures in the bottom of the stacking tray.

As noted above, a particular and long-standing problem with bottom sheet feeders is that the weight of the overlying stack of sheets creates a normal force between the bottom sheet and its immediately overlying sheet (the next to the bottom sheet) which creates a frictional resistance to separating and feeding out that bottom sheet from under the stack, and thus an increased likelihood of non-feeds (miss-feeds) or multifeeds (instead of single sheet feeds). This reduces the operating window for the sheet feeder-separator, which must compensate by increasing the effective frictional, vacuum, or other sheet attachment and sheet feeding force accordingly. This problem has been addressed in VCF (vacuum corrugating feeders), such as those in as the patents cited above, with "air knives" blowing air into the stack from at the edge of the stack to partially lift the overlying sheets of the stack to partially reduce the normal force from the overlying sheets while the bottom sheet is being acquired and held down by a vacuum attraction through apertured corrugated sheet feed belts. However, such VCF-air knife bottom feeder systems tend to be relatively large, expensive and somewhat noisy as compared to simpler, e.g., friction retard type, bottom feeders separators such as those cited above and others. They require a motor driven vacuum and air pressure supply system and pneumatic manifolds and solenoid actuated pneumatic valves.

However, as noted above, it is difficult to sufficiently increase the sheet feeding and separating force of a frictional type feeder-separator to overcome the overlying stack weight normal force for bottom feeding, and there are several problems. For example, smearing of print or other images on documents, especially, duplex documents printed on both sides, with the frictional feeder, especially in the nip of its retard separator. Or, scuffing of the sheets to create paper dust. Furthermore, the sheet feed rollers or belts can become contaminated with fuser oil by feeding previously fused xerographic copies, so that their coefficient of friction can be reduced to the point where they cannot do reliable, consistent, bottom sheet feeding, and misfeeds will occur. That can especially occur where a frictional retard type bottom feeder is used in a duplex buffer tray of a copier or printer to re-feed a stack of copy sheets just previously printed and fused on one side to be printed on their other side.

The disclosed system overcomes various of the above and other problems with a system which can utilize a non-pneumatic sheet feeder by providing a bottom sheet feeding system, with a sheet stacking tray with a tray bottom for stacking a stack of plural flimsy image substrate sheets for a reproduction apparatus, and a bottom sheet feeder for sequentially feeding the bottom individual said image substrate sheet in said sheet stacking tray out from under said stack of sheets overlying said bottom sheet; wherein the weight of said overlying stack of sheets is normally bearing down with gravitational normal force on said bottom sheet to resist the separation and feeding of said bottom sheet out from under said stack of sheets, the improvement comprising a stack levitation system for intermittently at least partially levitating said overlying stack of sheets in said sheet stacking tray relative to said bottom sheet to substantially reduce said gravitational force of said overlying stack of sheets on said bottom sheet, said stack levitation system comprising a cyclical transducer force applying system operating to provide cyclical vertical acceleration of said bottom of said stacking tray which intermittently levitates said overlying stack of sheets, and said bottom sheet feeder being operated for intermittent feeding of said bottom sheet out from under said overlying stack of sheets in said stacking tray in time coordination with said operation of said cyclical transducer force applying system to pull said bottom sheet out from under said overlying stack of sheets during said levitating of said overlying stack of sheets.

Further specific features disclosed herein, individually or in combination, include those wherein said bottom sheet feeder is an electrostatic sheet feeder which attracts said bottom sheet thereto with electrostatic force prior to said levitating of said overlying stack of sheets; and/or wherein said bottom sheet feeder intermittent feeding operation is in time spaced apart time increments substantially smaller than the total feeding time to feed said bottom sheet out from under said overlying stack of sheets; and/or wherein said stack levitation system cyclical transducer force applying system cyclical vertical acceleration of said bottom of said stacking tray is an acceleration of greater than one g downwardly; and/or wherein said stack levitation system cyclical transducer force applying system cyclical vertical acceleration of said bottom of said stacking tray is an acceleration of greater than one g both upwardly and downwardly; and/or wherein during said levitating of said overlying stack of sheets said overlying stack of sheets are free-falling towards said bottom of said stacking tray for a defined time period, and said bottom sheet feeder intermittent feeding operation is during said defined time period of free-falling of said overlying stack of sheets.

In reproduction apparatus such as xerographic and other copiers and printers or multifunction machines, it is increasingly important to provide more reliable and automatic handling of the physical image bearing sheets. It is desirable to reliably feed and accurately register document and/or copy sheets of a variety and/or mixture of sizes, types, weights, materials, humidity and other conditions, and susceptibility to damage. In particular, it is desirable to minimize sheet double-feeding (mis-separations), misfeeding, skewing, jamming, wear or damage. The sheets which may be handled in or outputted from reproduction apparatus may even have curls, wrinkles, tears, "dog-ears", cut-outs, overlays, tape, paste-ups, punched holes, staples, adhesive, slippery areas, or other irregularities. Sheets can vary considerably even if they are all of the same "standard" size, (e.g. letter size, legal size, A-4, B-4, etc.). They may have come from different paper batches or have variably changed size with different age or humidity conditions, different imaging, fusing, etc.

The disclosed system may be operated and controlled by appropriate operation of conventional control systems. It is well known and preferable to program and execute paper handling and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. It is well known that the control of document and copy sheet handling systems may be accomplished by conventionally actuating them with signals from a microprocessor controller directly or indirectly in response to simple programmed commands, and/or from selected actuation or non-actuation of conventional switch inputs. The resultant controller signals may conventionally actuate various conventional electrical solenoid or cam-controlled sheet deflector fingers, motors or clutches, or other components, in programmed steps or sequences. Conventional sheet path sensors or switches may be connected to the controller to be utilized for sensing, counting, and timing the positions of sheets in the sheet paths of the apparatus, and thereby also controlling the operation of sheet feeders, etc., as is well known in the art.

In the description herein the term "sheet" refers to a usually flimsy physical sheet of paper, plastic, or other suitable physical substrate for images, whether precut or web fed. A "copy sheet" may be abbreviated as a "copy". A "simplex" document or copy sheet is one having its image on only one side or face of the sheet, whereas a "duplex" document or copy sheet normally has images on both sides.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figures (approximately to scale) wherein:

Figure 1:
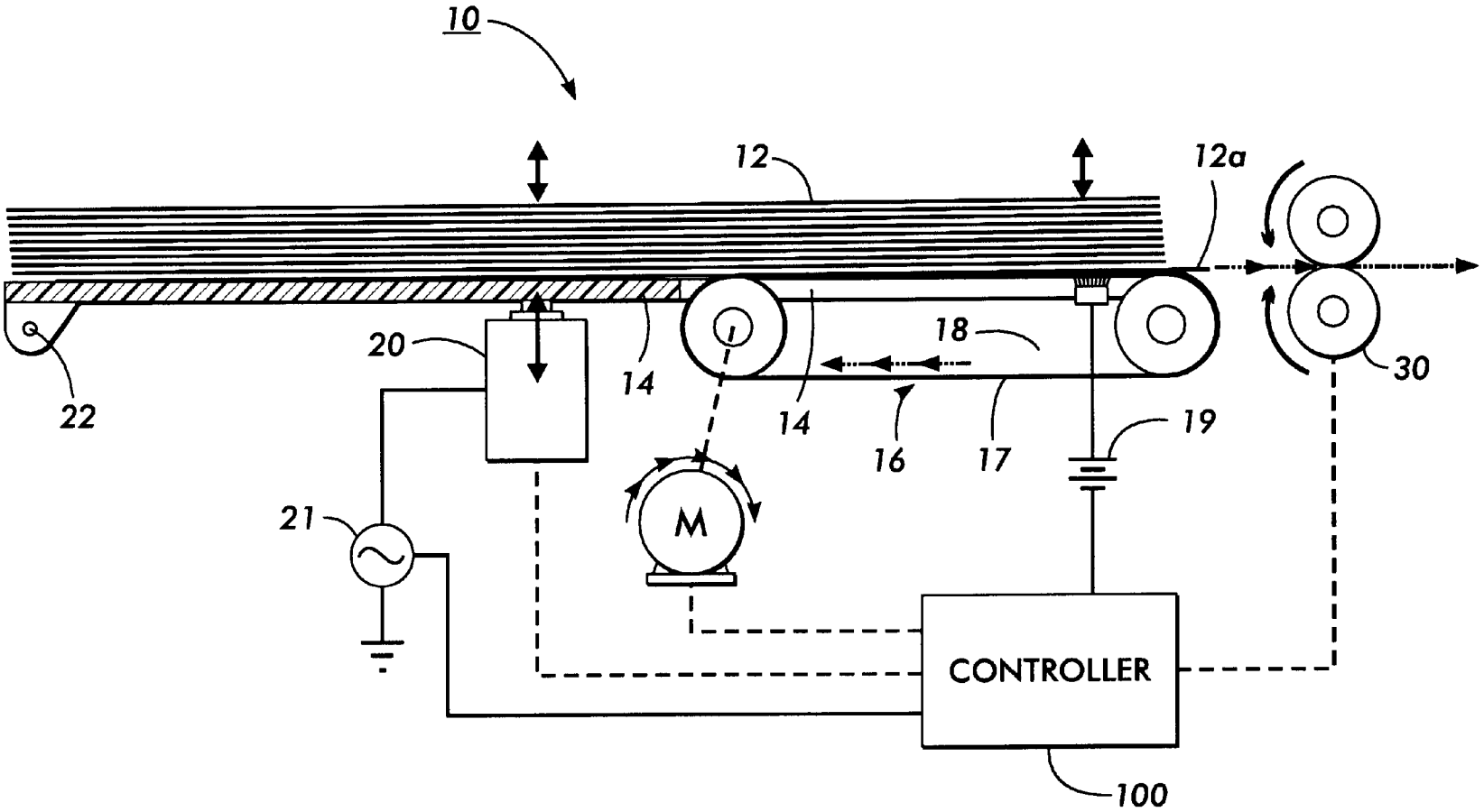
FIG. 1 is a schematic frontal view, partially cross-sectioned, of an embodiment of the subject bottom sheet feeding system.
Figure 2:
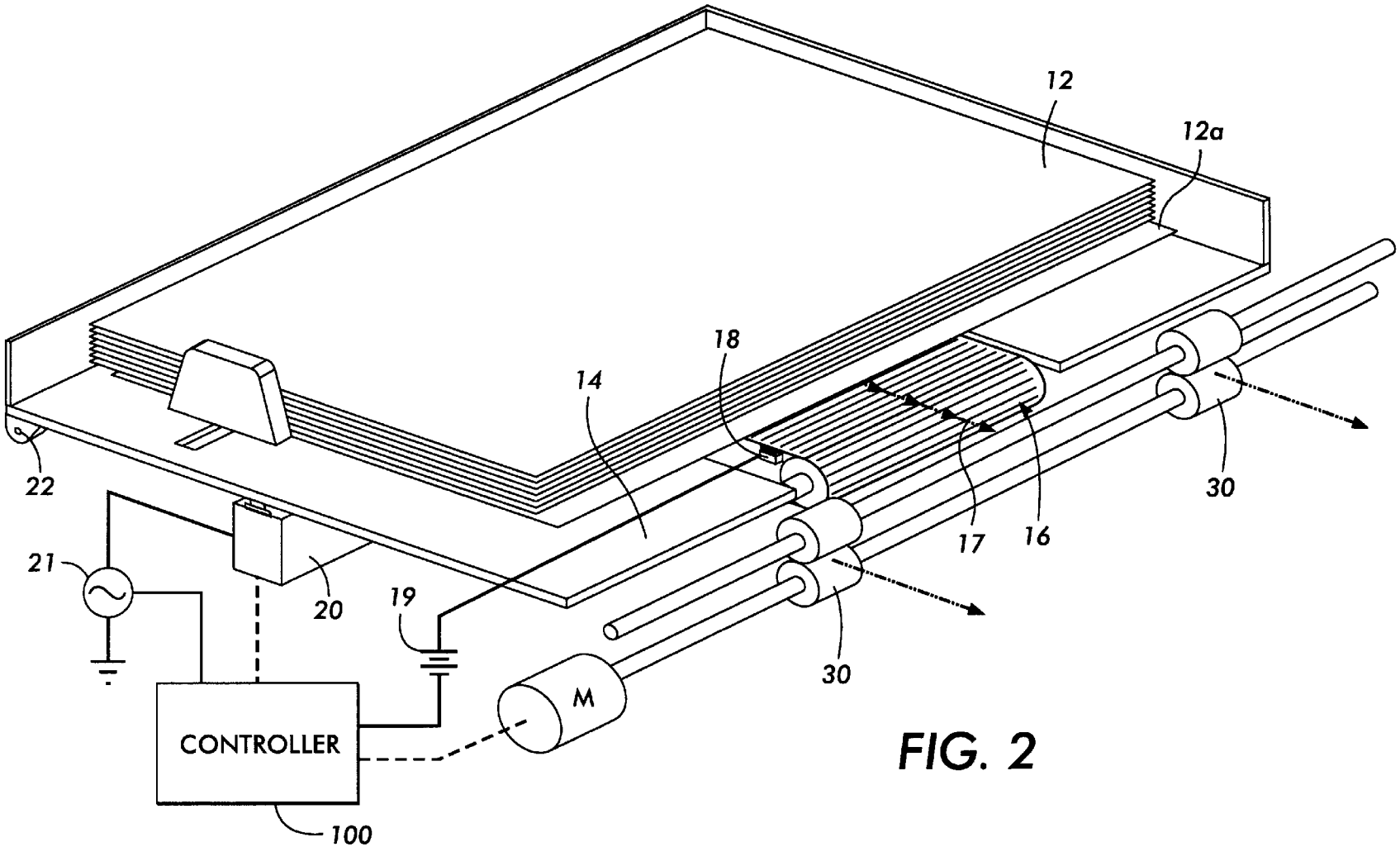
FIG. 2 is a perspective frontal view of the embodiment of FIG. 1.
Figure 3:
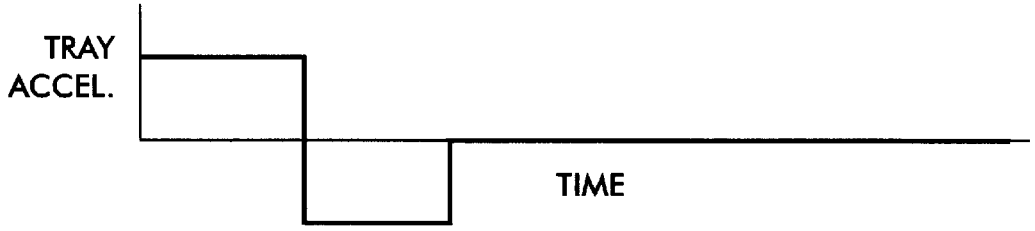
FIGS. 3–7 are related timing diagrams, on the same time lines, illustrating an exemplary operation of the embodiment of FIGS. 1 and 2.

Describing now in further detail the exemplary embodiment with reference to the Figures, there is shown a bottom sheet feeding system 10, by way of one example of the subject system. Here a stack of sheets 12 to be imaged or printed are conventionally placed in a stacking tray 14 for the sequential separation and feeding out from the bottom of the stack of the then bottom sheet 12*a* by a bottom sheet feeder 16. In this example, the bottom sheet feeder 16 is an electrostatic sheet feeder of a type known per se with a feed belt 17 driven by a stepper motor M. The belt 17 may be, e.g., mylar with an internal pattern of electrodes charged and discharged by a high voltage, low current, power supply 19 though a contact brush 18 or otherwise. That provides an electrostatic force field attracting the bottom sheet 12*a* to the belt 17. The feed belt 17 may have a frictional outer surface to feed the acquired bottom sheet out when the belt 17 is rotatably driven as shown by the motor M. Once the bottom sheet 12*a* has thus been partially driven out from the rest of the stack of sheets 12 it may be conventionally acquired and rapidly continuously pulled out the rest of the way and driven away by conventional take-away rollers 30. All of the active components here may be conventionally controlled by the conventional machine controller 100, as described above.

Turning now to the details of the coordinated levitation system in this bottom sheet feeding system 10 comprising one or more known low frequency power transducer(s) 20 are connected to intermittently and/or cyclically levitate the stacking tray 14 by being supplied with an intermittent pulsed or alternating electrical power source 21, also actuated or controlled by the controller 100. The tray 14 bottom surface is at least partially vertically movable by the transducer system. As shown in this example, the tray 14 may simply be hinged for pivotal movement at its rear or upstream end with a hinge mounting 22. (Alternatively, or additionally, the tray bottom could be spring mounted on springs, or be flexible.) This allows the transducer 20 to rapidly vertically accelerate upwardly and downwardly substantially the entire tray 14 (or at least a substantial stack supporting portion thereof). The transduced upward acceleration of the tray bottom correspondingly accelerates upwardly the entire stack of sheets 12 supported thereon, and then leaves them temporarily suspended above the tray 14 as the tray bottom is accelerated downwardly faster than the stack of sheets can fall by gravity, thereby temporarily removing most of the weight of the stack from the bottom sheet 12*a*, so that, with proper coordinated timing, the bottom sheet feeder 16 can partially pull out the bottom sheet 12*a* while the stack is so levitated with greatly reduced resistance and/or without other above-noted bottom feeding problems. Various known transducers may be used to provide a desired preset or variable frequency and amplitude of this positive and negative acceleration of tray 14; e.g., electromagnetic or solenoid transducers, or motor driven cams or other eccentrics engaging cam follower surfaces on the movable tray 14, etc.

Figure 4:
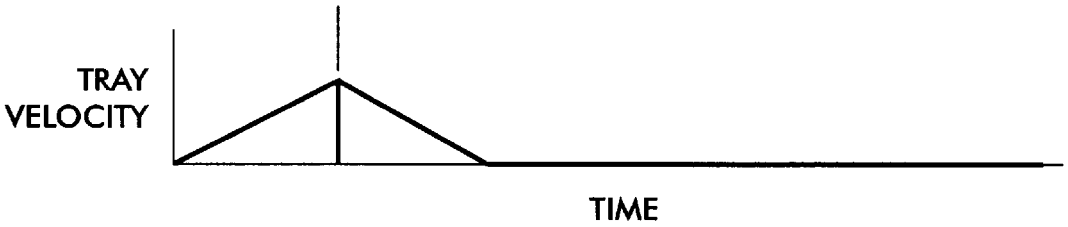
Figure 5:
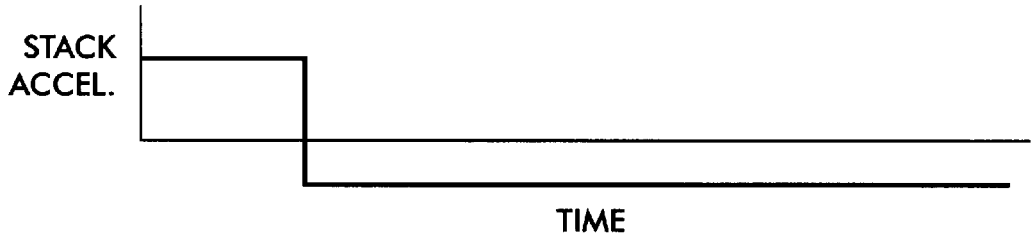
Figure 6:
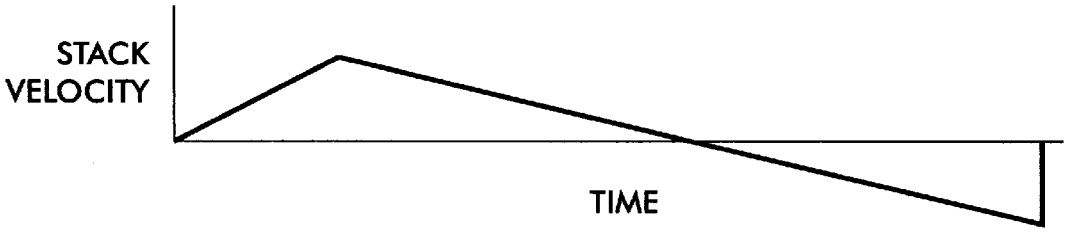
Figure 7:
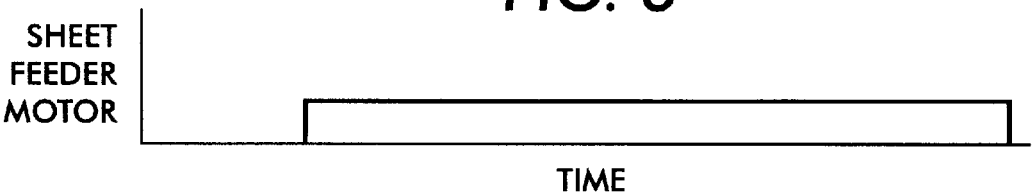

Exemplary respective schematic timings for one cycle of this operation of feeding one bottom sheet 12*a* are shown in FIGS. 3–7, which FIGS. are all on the same time lines, and with some of them somewhat simplified for illustration here. To further provide a numerical example therefor, first note the cycle of an upward and downward acceleration shown in the FIG. 3 example. Assume the transducer 20 is first driven to apply 1.5 g for the illustrated upward acceleration to the tray 14 for 9.28 ms, immediately followed by minus or downward 1.5 g acceleration to the tray 14 for the next 9.28 ms, for an 18.56 ms single feed cycle. That produces, as shown in FIG. 4, an increasing upward, and then downward, tray 14 velocity for those same two time periods, peaking at about plus 5.38 ips and then minus 5.38 ips, in this example. FIG. 5 then shows the corresponding paper stack acceleration profile. The stack of sheets is upwardly accelerated the same as the tray 14. However, since the sheets are not fastened to the tray, in the next half of the cycle, as the tray 14 accelerates downwardly by more than 1 g, the stack does not. The sheets may initially continue to rise briefly after the upward tray movement stops, due to their momentum. Then the sheets will accelerate downwardly, but only at 1 g, from gravity, and only initially. Then the further fall of the sheets is slowed by air resistance and the pressure of air trapped under the levitated sheets. Thus, as shown in FIG. 6, the stack can effectively "float" above the tray 14 for a substantial time period before the force of gravity alone (1 g, minus air resistance to the stack dropping) brings the stack back down onto the tray with its full weight. That is, as shown in FIG. 6, there is a defined time period before the stack once more comes to rest on the tray 14 pressing down on the (next) bottom sheet 12*a*. In that defined time period, about 32 ms in this example, (which time period starts after the above-noted first or initial time period in which the stack was being accelerated upwardly), as shown in FIG. 7 the sheet feeder motor M is turned on to pull the bottom sheet 12*a* out from under the levitated stack without the stack weight normal force bearing on the feed head or the bottom sheet, and thereby reducing multifeeds, potential smearing or wear, etc.

Then, the above-described and illustrated cycle may be repeated for the next sheet to be fed, and so on. The frequency and other characteristics of this cyclical operation may vary, of course, depending on the feeding rate and other factors. In the specific example here, the transducer cyclic frequency rate is only about 28 cps. As used herein, as shown, the term cyclical is not limited to either regular, even or sinusoidal movements.

To express this cycle another way, the bottom sheet 12*a* may first be electrostatically or otherwise acquired by the feed belt 17 before the transducer(s) 20 levitate the stack, then the stack is levitated by quickly raising the tray up and then pulling it down, and the feed belt 17 is advanced while the stack is levitated. That provides for at least a partial bottom sheet feed. Subsequent such cycles will advance the bottom sheet by an incremental amount sufficient for the bottom sheet to feed out far enough to be acquired by the take-away rollers 30. These feeds are while the stack is falling back down to the tray surface, with little or no normal force on the bottom sheet. Note that this is provided by the tray accelerating downwardly at a faster acceleration rate than the free-falling stack. These reciprocal up-down movement distances of the tray need not be large, e.g., assume an amplitude of only 0.025" for the FIG. 3–7 described example. With this example of that amplitude and a 1.5 g upward tray acceleration, the stack will continue to rise for about 13.83 ms after the tray reverses to reach a peak stack elevation of about 0.065", and then the stack will take at least another 17.9 ms to fall back onto the lowered tray, in a stack levitation cycle time of about 41 ms. With a 20 ips sheet feeder, driving the bottom sheet forward during this approximately 13.83+17.9=31.73 ms the stack is above the tray, the sheet may be fed about 0.636" in one such levitation cycle, for an overall average feed rate of 15.47 ips.

As noted, it is not necessary to levitate the stack for its entire feed-out, only long enough to feed the sheet up to the take-away rolls, but if that were desired, it could be done. An 8.5" letter size sheet feed in this example only when levitated would take about 13 cycles, or 0.549 seconds, to fully feed out from under the stack, thus providing 60 sheet feeds per minute even after allowing for acquisition time and inter-document pitch space. As with other electrostatic and other feeders, conventional sheet static eliminators may be provided downstream to remove any charges on the sheet.

The descriptions and expressions herein as to accelerating the tray or tray bottom may also encompass a transducer system reciprocally driving plural pins, posts, bars or the like up through, and then back down below, holes in a fixed tray bottom to form an intermittent active effective tray bottom therewith.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a bottom sheet feeding system, with a sheet stacking tray with a tray bottom for stacking a stack of plural flimsy image substrate sheets for a reproduction apparatus, and a bottom sheet feeder for sequentially feeding the bottom individual said image substrate sheet in said sheet stacking tray out from under said stack of sheets overlying said bottom sheet; wherein the weight of said overlying stack of sheets is normally bearing down with gravitational normal force on said bottom sheet to resist the separation and feeding of said bottom sheet out from under said stack of sheets, the improvement comprising:

a stack levitation system for intermittently at least partially levitating said overlying stack of sheets in said sheet stacking tray relative to said bottom sheet to substantially reduce said gravitational force of said overlying stack of sheets on said bottom sheet, said stack levitation system comprising a cyclical transducer force applying system operating to provide cyclical vertical acceleration of said bottom of said stacking tray which intermittently levitates said overlying stack of sheets, and said bottom sheet feeder being operated for intermittent feeding of said bottom sheet out from under said overlying stack of sheets in said stacking tray in time coordination with said operation of said cyclical transducer force applying system to pull said bottom sheet out from under said overlying stack of sheets during said levitating of said overlying stack of sheets.

2. The bottom sheet feeding system of claim 1, wherein said bottom sheet feeder is an electrostatic sheet feeder which attracts said bottom sheet thereto with electrostatic force prior to said levitating of said overlying stack of sheets.

3. The bottom sheet feeding system of claim 1, wherein said bottom sheet feeder intermittent feeding operation is in time spaced apart time increments substantially smaller than the total feeding time to feed said bottom sheet out from under said overlying stack of sheets.

4. The bottom sheet feeding system of claim 1, wherein said stack levitation system cyclical transducer force applying system cyclical vertical acceleration of said bottom of said stacking tray is an acceleration of greater than one g downwardly.

5. The bottom sheet feeding system of claim 1, wherein said stack levitation system cyclical transducer force applying system cyclical vertical acceleration of said bottom of said stacking tray is an acceleration of greater than one g both upwardly and downwardly.

6. The bottom sheet feeding system of claim 1, wherein during said levitating of said overlying stack of sheets said overlying stack of sheets are free-falling towards said bottom of said stacking tray for a defined time period, and said bottom sheet feeder intermittent feeding operation is during said defined time period of free-falling of said overlying stack of sheets.

* * * * *